US009744389B2

(12) United States Patent
Qiang et al.

(10) Patent No.: US 9,744,389 B2
(45) **Date of Patent: *Aug. 29, 2017**

(54) PORTABLE FIRE EXTINGUISHING APPARATUS

(75) Inventors: Jian Qiang, Xi'an (CN); Yanbin Yang, Xi'an (CN); Zhengjun Lei, Xi'an (CN)

(73) Assignee: XI'AN J&R FIRE FIGHTING EQUIPMENT CO., LTD., Shaanxi (CN)

( * ) Notice: Subject to any disclaimer, the term of this patent is extended or adjusted under 35 U.S.C. 154(b) by 295 days.

This patent is subject to a terminal disclaimer.

(21) Appl. No.: 14/347,447

(22) PCT Filed: Aug. 17, 2012

(86) PCT No.: PCT/CN2012/080306

§ 371 (c)(1),
(2), (4) Date: Mar. 26, 2014

(87) PCT Pub. No.: WO2013/044703

PCT Pub. Date: Apr. 4, 2013

(65) Prior Publication Data

US 2014/0231108 A1 Aug. 21, 2014

(30) Foreign Application Priority Data

Sep. 28, 2011 (CN) ..... 2011 2 0377310 U

(51) Int. Cl.
*A62C 13/76* (2006.01)
*A62C 13/64* (2006.01)
(Continued)

(52) U.S. Cl.
CPC ..... *A62C 13/64* (2013.01); *A62C 13/20* (2013.01); *A62C 13/22* (2013.01); *A62C 19/00* (2013.01)

(58) Field of Classification Search
CPC ..... A62C 13/76; A62C 13/22; A62C 13/64; A62C 5/006; A62C 13/20; A62C 19/00
(Continued)

(56) References Cited

U.S. PATENT DOCUMENTS 1,588,234 A 3/1923 Kauch
2,057,840 A 1/1935 Neumann
(Continued)

FOREIGN PATENT DOCUMENTS

CA 2758603 A1 8/2011
CN 2395749 Y 9/2000
(Continued)

OTHER PUBLICATIONS

International Search Report for corresponding application PCT/CN2012/080306 filed Aug. 17, 2012; dated Nov. 8, 2012.
(Continued)

*Primary Examiner* — Jason Boeckmann
(74) *Attorney, Agent, or Firm* — Cantor Colburn LLP

(57) ABSTRACT

A portable fire extinguishing apparatus, which comprises a casing (20) and a cartridge (3) arranged inside the casing (20). The top end of the cartridge (3) is fixedly connected with the casing (20) through a snap ring (24); the bottom of the cartridge (3) is fixedly connected with the casing (20) through some nuts and bolts; and an explosion venting unit (2) is arranged at the jet end of the cartridge (3). Kinetic energy generated from explosion is consumed through shifting and limiting processes of the explosion venting units (2), therefore recoil force or forward impact force generated after explosion of explosives can be consumed or released, so that safe and effective explosion venting is achieved and hurt to human bodies or articles after explosion of grains is avoided.

10 Claims, 4 Drawing Sheets

(51) Int. Cl.
*A62C 13/20* (2006.01)
*A62C 13/22* (2006.01)
*A62C 19/00* (2006.01)

(58) Field of Classification Search
USPC ..... 169/28, 30, 75, 80
See application file for complete search history.

(56) References Cited

U.S. PATENT DOCUMENTS

| | | | | |
|---|---|---|---|---|
| 2,502,923 | A | 2/1949 | Burgoyne | |
| 2,865,456 | A | 8/1956 | Dennis | |
| 2,960,369 | A * | 11/1960 | Goldie | A62C 13/006 169/9 |
| 4,197,213 | A | 4/1980 | Pietz | |
| 5,282,541 | A | 2/1994 | Chen | |
| 5,992,531 | A | 11/1999 | Mikulec | |
| 8,800,676 | B2 | 8/2014 | Guo | |
| 8,844,644 | B2 | 9/2014 | Guo | |
| 2006/0175067 | A1 | 8/2006 | Cover | |
| 2011/0155398 | A1 | 6/2011 | Holland | |
| 2013/0175061 | A1 * | 7/2013 | Guo | A62C 13/003 169/71 |

FOREIGN PATENT DOCUMENTS

| | | | |
|---|---|---|---|
| CN | 1378867 | | 11/2002 |
| CN | 201815031 | * | 5/2011 |
| CN | 202236978 | U | 5/2012 |
| CN | 202236979 | U | 5/2012 |
| CN | 202236980 | U | 5/2012 |
| CN | 202236991 | U | 5/2012 |
| DE | 8900351 | U1 | 3/1989 |
| EP | 0693303 | A2 | 1/1996 |
| EP | 0750923 | | 1/1997 |
| EP | 0750923 | A2 | 1/1997 |
| FR | 2647354 | A1 | 11/1990 |
| GB | 2190586 | | 11/1987 |
| JP | 8252338 | | 10/1996 |
| JP | 2011062340 | A | 3/2011 |
| WO | 2011091652 | A1 | 8/2011 |

OTHER PUBLICATIONS

International Search Report for corresponding application PCT/CN2012/080226 filed Aug. 16, 2012; dated Nov. 15, 2012.

International Search Report for corresponding application PCT/CN2012/080225 filed Aug. 16, 2012; dated Nov. 8, 2012.

European Search Report for corresponding application 12 83 5013.9; dated May 15, 2015.

European Search Report for corresponding application EP12835355: Report dated Jun. 12, 2015.

* cited by examiner

PORTABLE FIRE EXTINGUISHING APPARATUS

TECHNICAL FIELD OF THE INVENTION

The invention belongs to the field of fire prevention technology, and particularly relating to a portable fire extinguishing apparatus.

BACKGROUND OF THE INVENTION

At present, existing portable fire extinguishing apparatuses are generally divided into pressure-storage dry powder fire extinguishing apparatuses and handheld aerosol fire extinguishing apparatuses, wherein a pressure-storage dry powder fire extinguishing apparatus mainly have the following disadvantages: firstly, the pressure-storage dry powder fire extinguishing apparatus causes serious pollution to the environment and serious damage to materials; secondly, the pressure-storage dry powder fire extinguishing apparatus, which needs to store high pressure gases, is large in volume and heavy in weight; thirdly, the pressure-storage dry powder fire extinguishing apparatus, which is a high pressure container, has potential safety hazards and is more dangerous in a high temperature environment of a fire; fourthly, the pressure-storage dry powder fire extinguishing apparatus, which needs to go through regular surveillance tests and inspections, is high in routine maintenance costs etc. By contrast, a portable aerosol fire extinguishing apparatus has obvious advantages and mainly comprises: a cartridge, a cartridge cover arranged on the cartridge, and a pyrotechnic composition, an ignition head, a coolant and a ceramic chip etc. arranged in the cartridge in turn and coated by a heat insulation material. Normally, after the pyrotechnic composition is ignited by the ignition head, a great deal of aerosol smog will be generated by the cartridge through rapid stratified combustion, and after being cooled by a coolant layer, these high temperature aerosols will be ejected from the cartridge cover of the cartridge to act on a fire source directly, thus extinguishing the fire. However, there are also some disadvantages. A coating defect, a pyrotechnic composition crack or a serious blockage of a gas channel may lead to a sudden rise of the pressure in the cartridge to deflagrate the cartridge. As a result, a high pressure gas will thrust the cartridge cover of the cartridge forwards and will be vented rapidly to cast the cartridge cover of the cartridge and other substances in the cartridge forwards at an extremely high speed, thus causing a very large recoil force. The powerful recoil force drives the cartridge cover to move backwards rapidly, which is easy to cause an injury to an operator. At the same time, after explosion venting, the cartridge cover of the inner cartridge of the extinguishing apparatus will also break away from the cartridge and fly outwards for a relatively long distance, which may cause other accidents. In addition, the cartridge of the extinguishing apparatus is easily loosened in a casing and the problem of fixation of the cartridge is a subject to be solved.

SUMMARY OF THE INVENTION

To solve disadvantages existing in a portable fire extinguishing apparatus in the prior art, the invention provides a portable fire extinguishing apparatus provided with an explosion prevention facility and capable of effectively preventing explosion, releasing pressure and reducing a recoil force after deflagration.

The technical solution applied by the invention to solve the technical problem above is:

a portable fire extinguishing apparatus, comprising: a casing (20) and a cartridge (3) arranged inside the casing (20), wherein the top end of the cartridge (3) is fixedly connected with the casing (20) through a snap ring (24); the bottom of the cartridge (3) is fixedly connected with the casing (20) through nuts and bolts, thus facilitating installation on one hand, and the cartridge is well secured in the casing at two sides so that the cartridge is not easily rotated or loosened on the other hand.

An explosion venting device (2) is further arranged at the jet end of the cartridge (3) of the fire extinguishing apparatus of the invention to effectively prevent explosion and release pressure, reduce a recoil force acting on the cartridge (3) after deflagration and prevent a cartridge cover (4) of the cartridge (3) from flying outwards; the explosion venting device (2) mainly comprises a frictional layer (11), a connection rod (12), a connection rod guiding unit (13) and a connection rod limiting device (14), wherein the connection rod (12) is connected with the cartridge cover (4) of the cartridge (3); the frictional layer (11) is arranged between the connection rod (12) and an outer wall of the cartridge (3); the frictional layer (11) provides a frictional resistance and a buffering force for the connection rod (12) when the same is guided by the connection rod guiding unit (13) to displace along a direction towards which a hot air stream of the cartridge (3) is ejected; the connection rod guiding unit (13) is a device capable of providing a guiding function for the connection rod (12) when the same is moving; the connection rod limiting device (14) is a device capable of limiting the connection rod (12) when an extremity of the same reaches an spout of the cartridge (3). Powerful kinetic energy generated after deflagration of a grain is converted into deformation energy and overcoming resistance etc. through frictional acting and energy conversion and is dispersed or consumed, thus effectively releasing the pressure and reducing the recoil force.

The connection rod guiding unit (13) may be a guiding ring (15) fixedly connected with the connection rod (12) or a guiding groove provided on the outer wall of the cartridge (3) and capable of enabling the connection rod (12) to slide axially along the guiding groove; at the same time, the connection rod limiting device (14) comprises a flanging (16) fixedly connected with the jet end of the cartridge (3) and a clamping claw (17) for fixing the connection rod (12); in addition, an elastic body (18) may be further arranged between the flanging (16) and the connection rod guiding unit (13) or is arranged on a side face of the flanging (16).

A plurality of cartridges (3) may be arranged in the casing (20) of the invention, and the bottoms of the cartridges (3) are fixedly connected with the casing (20) through bolts and nuts, thus the cartridges (3) can be fixed by aligning the bottoms of the cartridges (3) with screw holes of the casing (20) and tightening the nuts so as to prevent the cartridges (3) from rotating in the casing (20).

The snap ring (24) may be composed of two half snap rings matched with each other so as to fixedly connect the cartridge (3) and the casing (20).

The casing (20) of the invention is prism-shaped and made of an aluminum material, thus reducing cost and achieving a good cooling effect.

The bottom end of the casing (20) of the invention is further provided with a bent handlebar (23); piezoelectric ceramics and a safety pin are arranged in the bent handlebar (23); the safety pin is unlocked through a pull ring arranged out of the bent handlebar (23); the bent handlebar (23) may be further provided as a telescopic bent handlebar, which is convenient to start and operate.

The portable fire extinguishing apparatus of the invention mainly has the following advantages:

1. the cartridge of the invention is fixed in the casing through the bolts and nuts at the bottom and the snap ring at the top, which on the one hand facilitates installation, and on the other hand allows the cartridge to be fixed appropriately within the casing, thus not easily rotated or loosened, also, obviated is the need for a production site that is required while waiting for silicone solidification by leaving to stand for seven to eight hours when silicone injection for fixing is used, thus improving production efficiency;

2. the fire extinguishing apparatus of the invention is provided with the explosion venting device on the cartridge, thus consuming or reducing a recoil force or a forward impact force generated by deflagration of an explosive to vent explosion safely and effectively and avoid injuries and damages caused after deflagration of the grain mainly through consuming kinetic energy generated by the deflagration in a shifting and limiting process of the explosion venting device;

3. the connection rod and the cartridge cover of the cartridge of the invention are connected and apply a structure of a flanging and a clamping claw, thus effectively controlling a motion of the connection rod, and the structure can effectively prevent a powerful impact force from acting on the cartridge cover of the cartridge to thrust the cartridge cover apart from the cartridge, thus preventing accidental injuries caused after the cartridge cover flies outwards;

4. the invention is started by piezoelectric ceramics, thus avoiding replacement of batteries and routine maintenance and saving maintenance costs.

Figure 1:
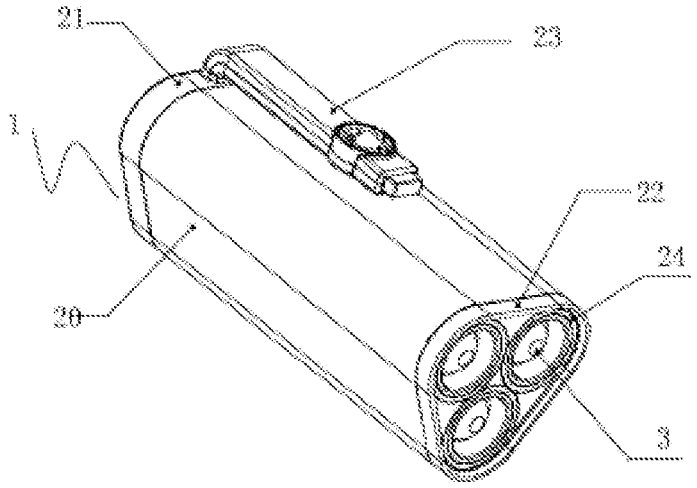
FIG. 1 is a structural diagram of a fire extinguishing apparatus of the invention.

In the drawings: 1—fire extinguishing apparatus, 2—explosion venting device, 3—cartridge, 4—cartridge cover, 5—ceramic cellular cooling layer, 6—coolant, 7—grain, 8—ignition head, 9—sealing ring, 10—rubber plug, 11—frictional layer, 12—connection rod, 13—connection rod guiding unit, 14—connection rod limiting device, 15—guiding ring, 16—flanging, 17—clamping claw, 18—elastic body, 19—heat insulation layer, 20—casing, 21—bottom cover, 22—top cover, 23—bent handlebar, 24—clamping ring.

DETAILED DESCRIPTION OF THE EMBODIMENTS

The invention provides a portable fire extinguishing apparatus and preferred embodiments of the invention will be further described in combination with the accompanying drawings:

Referring to FIG. 1, the fire extinguishing apparatus 1 is mainly composed of a casing 20, a bottom cover 21 and a top cover 21 of the casing 20, a cartridge 3, a cartridge cover 4 of the cartridge, an explosion venting device 2 and a bent handlebar 23, wherein the casing 20 is prism-shaped and made of an extruded aluminium material, thus achieving a good cooling effect; the top cover 22 and the bottom cover 21 of the casing 20 are matched with the casing 20, and the lower ends of the top cover and the bottom cover extend into the casing 20 respectively; the bottom of the cartridge 3 of the invention is locked on the bottom cover 21 of the casing 20 through bolts and nuts, and the top of the cartridge is clamped through a snap ring 24 consisting of two half snap rings and is matched with the top cover 22 of the casing 20, so that the cartridge 3 is tightly locked and fixed at the top and the bottom, thus preventing the cartridge from oscillating or rotating in the casing 20; in assembly, the top of the cartridge 3 is clamped by the two half snap rings to clamp the cartridge right in a corresponding installation hole of the top cover 22, i.e. the top of the cartridge 3 is pressed on one half snap ring while the other half snap ring is pressed into the top cover 22 subsequently; the top cover 22 is then pressed into the aluminum casing 20; then the bottom cover 21 is installed and the bottom of the cartridge 3 is locked and attached with the bottom cover 21 to complete assembly of the cartridge 3. A plurality of cartridges 3 may be arranged in the casing 20, preferably three.

Figure 2:
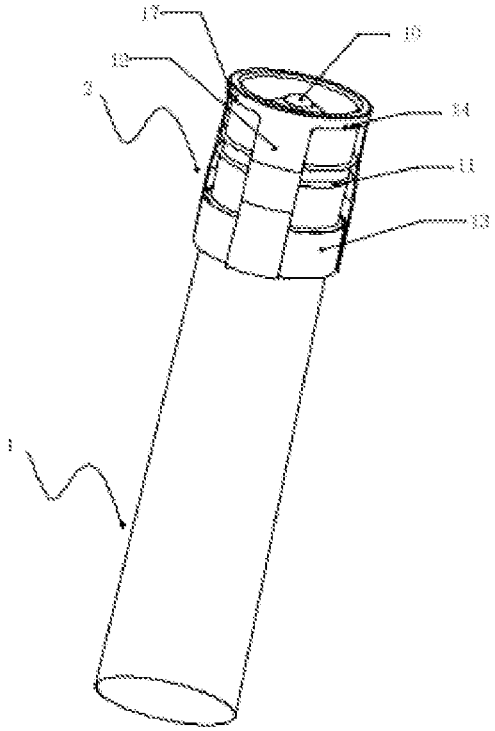
FIG. 2 is a structural diagram of a cartridge of the invention.
Figure 3:
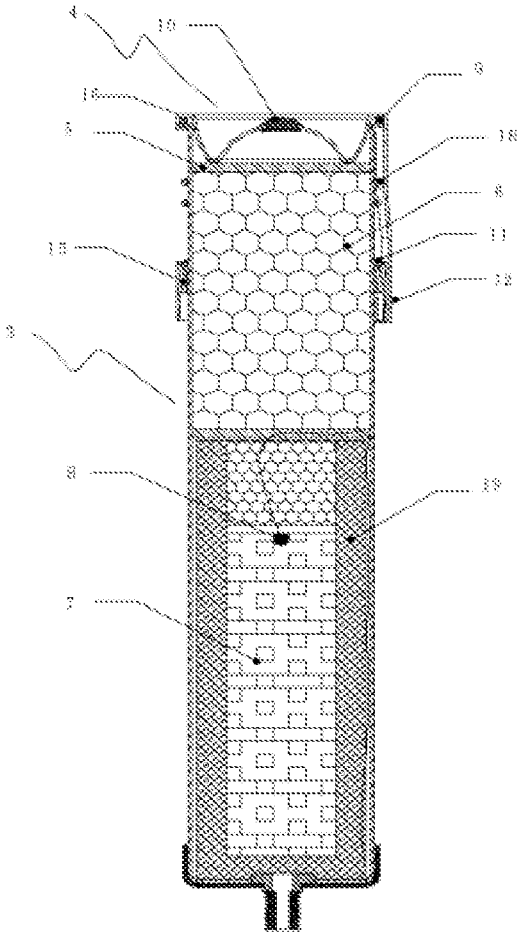
FIG. 3 is a sectional view of a structure of a cartridge of the invention.

Referring to FIG. 2 and FIG. 3, the cartridge cover 4 of the cartridge may be further arranged on the top end of the cartridge 3 of the invention; a ceramic cellular cooling layer 5, a coolant 6, a grain 7 and an ignition head 8 arranged on the section of the front end of the grain 7 are arranged in the cartridge 3 in turn; generally, the cartridge 3 and the cartridge cover 4 of the cartridge are connected hermetically through a sealing ring 9, wherein the section of the sealing ring 9 may be square, circular or in other shapes; the cartridge cover 4 of the cartridge comprises a spout and a trumpet nozzle, and the center of the spout faces the center of the trumpet nozzle; the spout may be sealed by a rubber plug 10 or an aluminium foil; in addition, the ceramic cellular cooling layer 5 can fix the coolant 6 to prevent the coolant from dropping out on one hand, and have a physical cooling effect to reduce the temperature of a high temperature hot aerosol on the other hand; generally, the ceramic cellular cooling layer 5 may be arranged at the front end of the coolant 6, may be also provided in the middle of the coolant 6, or may be also provided at both the front end and the middle section of the coolant 6, and the positions and quantity of ceramic cellular cooling layers are determined according to actual application conditions; one end of the trumpet nozzle having a relatively large diameter of the invention is connected with the cellular cooling layer, thus guiding an aerosol to be ejected from the spout, and the trumpet nozzle may be integrated with the cartridge cover; a heat insulation layer 19 may be further added between the grain 7 and the inner wall of the cartridge 3 to have a heat insulation effect and prevent people or materials from being burnt by heat generated after ignition of the aerosol.

The explosion venting device 2 of the invention mainly comprises a frictional layer 11, a connection rod 12, a connection rod guiding unit 13, a connection rod limiting device 14 and an elastic body 18, wherein the connection rod 12 is connected on the cartridge cover 4 of the cartridge, and may be fixedly connected through welding and rivet joint etc., or may be also integrated directly, thus the structural strength is higher; the frictional layer 11 may be one or more rubber rings or silicone layers or other materials capable of providing enough frictional resistance for axial sliding of the connection rod 12; the frictional layer 11 may be arranged between the connection rod 12 and the cartridge 3, or may be directly fixed at an inner side of the connection rod 12; the frictional layer 11 provides a frictional resistance and a buffering force for the connection rod 12 when the same is guided by the connection rod guiding unit 13 to displace along an axial direction of the cartridge 3; the connection rod guiding unit 13 is a device capable of providing a guiding function for the connection rod 12 when the same is moving, and may be a guiding ring 15 fixedly connected with the connection rod 12, or may be also a guiding groove provided on the outer wall of the cartridge 3 and capable of enabling the connection rod 12 to slide along the guiding groove, or other structures having a guiding function; this guiding structure can prevent the connection rod 12 from being offset or locked during a moving process of the cartridge 3; when the guiding ring 15 is applied to guiding, the guiding ring 15 may be fixedly connected with an extremity of the connection rod 12 or directly integrated with the connection rod 12; the connection rod limiting device 14 of the invention is fixedly connected with the cartridge cover 4 of the cartridge and the connection rod 12; when the extremity of the connection rod 12 reaches a position as illustrated of the cartridge cover 4 of the cartridge, the connection rod is limited by the connection rod limiting device 14; the connection rod limiting device 14 mainly comprises a flanging 16 and a clamping claw 17, wherein the flanging 16 and the cartridge 3 are fixedly connected, or may be also integrated directly, and one end of the clamping claw 17 is fixed on the connection rod 12 while the other end is clamped with the cartridge 3 to mainly fix the connection rod 12; the connection rod 12 may be also integrated with the clamping claw 17, or the connection rod limiting device 14 of the invention may be also other structures, as long as the connection rod 12 can be fixed on one hand, and the connection rod 12 can be blocked and prevented from being detached from the cartridge 3 on the other hand. The elastic body 18 may be further arranged between the flanging 16 of the invention and the connection rod guiding unit 13, or may be arranged on a side face of the flanging 16 to mainly buffer a collision force between the extremity of the connection rod 12 and the cartridge 3 or between the extremity of the connection rod 12 and the flanging 16, prolong collision time and release, by using the elastic property of the elastic body, a part of kinetic energy generated after deflagration.

The displacement of the connection rod 12 of the invention is preferably controlled within 50 to 60 mm, because excessive displacement will fail to reduce a recoil force; however, the kinetic energy cannot be consumed thoroughly by little displacement, and the cartridge cover of the cartridge is very likely to get rid of the blockage of the connection rod limiting device (14); once the cartridge cover of the cartridge is separated from the cartridge, a powerful recoil force will be generated; however, the displacement of the connection rod 12 may be adjusted appropriately according to a specific application environment, as long as an optimal explosion venting effect can be realized.

When the gain 7 of an inner cartridge is ignited and released normally, hot air is released from the spout of the cartridge cover 4 of the cartridge, and an oversize air stream will not be generated, thus the explosion venting device 2 will not be started; the connection rod 12, which is fixed on the cartridge 3 by the clamping claw 17, will not move to generate displacement along an axial direction of the cartridge 3; only when the cartridge cover 4 of the cartridge and the connection rod 12 are pushed by a powerful hot air stream generated by unexpected explosive deflagration to move in a direction towards which the hot air stream is ejected, the clamping claw 17 of the connection rod limiting device 14 slips under the action of a powerful impact force on one hand to consume a part of the impact kinetic energy; pushed by the hot air stream, the connection rod 12 drives the guiding ring 15 to slide axially along the outer wall of the cartridge 3 to generate displacement, and the frictional layer 11 generates frictional resistance to the connection rod during the moving process to consume a part of the impact kinetic energy; when the extremity of the connection rod 12 reaches the spout of the cartridge 3, the flanging 16 of the connection rod limiting device 14 fixed on the cartridge 3 stops the extremity of the connection rod 12 from being separated from the cartridge 3; at the moment, the elastic body 18 arranged between the flanging 16 and the guiding ring 15 functions to consume a part of the impact kinetic energy with its elasticity, and buffers the powerful impact force between the extremity of the connection rod 12 and the flanging 16 additionally; when the final kinetic energy acts on the flanging 16 in the form of collision, the flanging 16 is deformed elastically or plastically, which will consume all remaining kinetic energy; thus the powerful impact kinetic energy generated by deflagration of the grain 7 may be well consumed or dispersed in the whole process to avoid injuries or damages brought thereby.

A bent handlebar 23 extending out of the casing 20 is further provided at the bottom of the casing 20 of the invention, wherein a PC elastic sheet, piezoelectric ceramics and a safety pin are arranged in the bent handlebar 23; the safety pin is unlocked through a pull ring provided outside the bent handlebar 23; a starting push button may be arranged on a position that facilitates operation out of the bent handlebar 23, and may be started when pressed. A fixing cover is further arranged outside the bottom cover 21 of the casing 20 to fix the bent handlebar 23 on the bottom cover 21 through five bolts; the bent handlebar may be further provided as a telescopic bent handlebar which is pulled out in use and may be retracted when not in use, thus saving space. In use, the pull ring is pulled out to unlock the safety pin, and the press button is pressed to start the fire ignition head 8 of the fire extinguishing apparatus 1 through the piezoelectric ceramics, thus starting the fire extinguishing apparatus 1.

Figure 4:
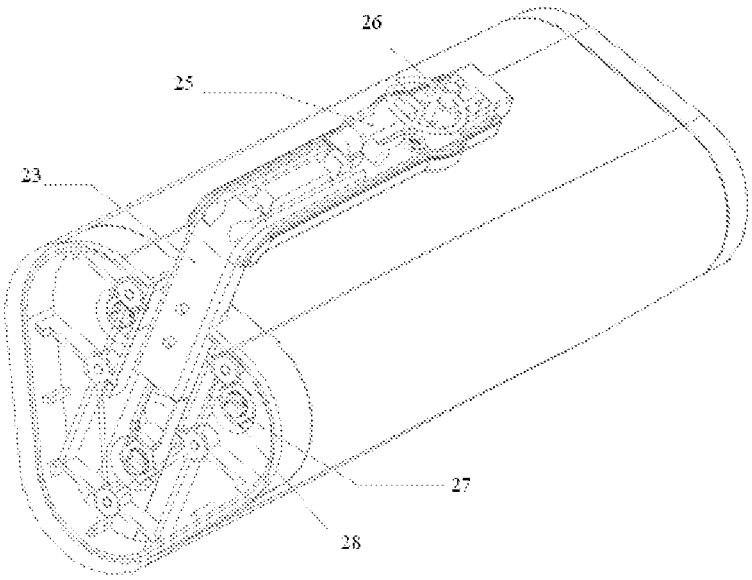
FIG. 4 is a partial structural diagram of a fire extinguishing apparatus of the invention (bottom cover not shown).

In the FIG. 4, a reference number 27 shows the feature "bolts", a reference number 28 shows the feature "nuts", a reference number 25 shows the feature "piezoelectric ceramics", a reference number 26 shows the feature "safety pin", a reference number 23 shows the feature "the telescopic bent handlebar".

The invention claimed is:

1. A portable fire extinguishing apparatus, comprising a casing (20) and a cartridge (3) arranged inside the casing (20), a top end of the cartridge (3) is fixedly connected with the casing (20) through a snap ring (24); a bottom of the cartridge (3) is fixedly connected with the casing (20);

wherein an explosion venting device (2) is arranged at a jet end of the cartridge (3); the explosion venting device (2) comprises a frictional layer (11), a connection rod (12), a connection rod guiding unit (13) and a connection rod limiting device (14);

the connection rod (12) is connected with a cartridge cover (4) of the cartridge (3);

the frictional layer (11) is arranged between the connection rod (12) and an outer wall of the cartridge (3); the frictional layer (11) provides a frictional resistance and a buffering force for the connection rod (12) when the same is guided by the connection rod guiding unit (13) to displace along a direction towards which a hot air stream of the cartridge (3) is ejected;

the connection rod guiding unit (13) is a device capable of providing a guiding function for the connection rod (12) when the same is moving;

the connection rod limiting device (14) is a device capable of limiting the connection rod (12) when an extremity of the same reaches an spout of the cartridge (3).

2. The portable fire extinguishing apparatus according to claim 1, wherein the connection rod guiding unit (13) is a guiding ring (15) fixedly connected with the connection rod (12) or a guiding groove provided on the outer wall of the cartridge (3) and capable of enabling the connection rod (12) to slide axially along the guiding groove; the connection rod limiting device (14) comprises a flanging (16) fixedly connected with the jet end of the cartridge (3) and a clamping claw (17) for fixing the connection rod (12); an elastic body (18) is arranged between the flanging (16) and the connection rod guiding unit (13) or is arranged on a side face of the flanging (16).

3. The portable fire extinguishing apparatus according to claim 1, wherein a plurality of cartridges (3) are arranged in the casing (20).

4. The portable fire extinguishing apparatus according to claim 1, wherein the casing (20) is prism-shaped and made of an aluminum material.

5. The portable fire extinguishing apparatus according to claim 4, wherein a bottom end of the casing (20) is further provided with a bent handlebar (23).

6. The portable fire extinguishing apparatus according to claim 5, wherein the bent handlebar (23) is telescopic.

7. The portable fire extinguishing apparatus according to claim 1, wherein the casing (20) is prism-shaped and made of an aluminum material.

8. The portable fire extinguishing apparatus according to claim 2, wherein the casing (20) is prism-shaped and made of an aluminum material.

9. The portable fire extinguishing apparatus according to claim 3, wherein the casing (20) is prism-shaped and made of an aluminum material.

10. The portable fire extinguishing apparatus according to claim 1, wherein the casing (20) is prism-shaped and made of an aluminum material.

* * * * *